US007892145B2

(12) United States Patent
Lovett et al.

(10) Patent No.: US 7,892,145 B2
(45) Date of Patent: Feb. 22, 2011

(54) RHYTHM ROPE

(75) Inventors: Bryson Lovett, Los Angeles, CA (US); Patricia L. Christen, Piedmont, CA (US); Frederick P. Dillon, IV, San Francisco, CA (US); Nicole Lee Guthrie, San Francisco, CA (US); Ellen Louise LaPointe, Oakland, CA (US); Lalita Kikuyo Suzuki, San Francisco, CA (US); Richard L. Tate, II, Oakland, CA (US); Mark A. Wallace, Redwood City, CA (US); Elizabeth Ji-Eun Song, Palo Alto, CA (US); Daniel E. Cawley, San Francisco, CA (US)

(73) Assignee: HopeLab Foundation, Inc., Redwood City, CA (US)

( * ) Notice: Subject to any disclaimer, the term of this patent is extended or adjusted under 35 U.S.C. 154(b) by 179 days.

(21) Appl. No.: 12/396,206

(22) Filed: Mar. 2, 2009

(65) Prior Publication Data

US 2009/0221401 A1 Sep. 3, 2009

Related U.S. Application Data

(60) Provisional application No. 61/032,896, filed on Feb. 29, 2008.

(51) Int. Cl.
*A63B 71/00* (2006.01)
*A63B 5/20* (2006.01)

(52) U.S. Cl. ..... 482/3; 482/1; 482/81; 482/82; 482/83; 482/84

(58) Field of Classification Search ..... 482/1, 482/3, 81–84; 446/242
See application file for complete search history.

(56) References Cited

U.S. PATENT DOCUMENTS 3,778,053 A * 12/1973 Smith et al. ..... 482/82
4,072,930 A 2/1978 Lucero et al.
4,307,538 A 12/1981 Moffitt (Continued)

FOREIGN PATENT DOCUMENTS

WO WO95/04430 A1 2/1995

(Continued)

OTHER PUBLICATIONS

Christen et al.; U.S. Appl. No. 12/390,297 entitled "A method to optimize interactive products based on their functional neural impact," filed Feb. 20, 2009.

(Continued)

*Primary Examiner*—Tatyana Zalukaeva
*Assistant Examiner*—Shila Abyaneh
(74) *Attorney, Agent, or Firm*—Shay Glenn LLP

(57) ABSTRACT

The improved jump ropes devices described herein generally include a source of rhythmic sound, a sensor for determining the motion of the jump rope, and a visual output (e.g., feedback) for indicating how well a user is moving or jumping in time to the rhythmic component of the sound. The device may also include a controller for receiving input from the source of rhythmic sound and the sensor, and controlling the visual output. Methods of using the devices are also described.

18 Claims, 2 Drawing Sheets

U.S. PATENT DOCUMENTS

| | | | | |
|---|---|---|---|---|
| 4,529,193 | A | 7/1985 | Kuhnsman | |
| 4,720,789 | A | 1/1988 | Hector et al. | |
| 4,776,585 | A | 10/1988 | Maleyko et al. | |
| 5,071,118 | A | 12/1991 | Barnett | |
| 5,087,034 | A | 2/1992 | Solis | |
| 5,139,261 | A | 8/1992 | Openiano | |
| 5,307,263 | A | 4/1994 | Brown | |
| 5,389,056 | A | 2/1995 | Ricker | |
| 5,533,947 | A * | 7/1996 | Tomlinson et al. | 482/6 |
| 5,678,571 | A | 10/1997 | Brown | |
| 5,730,654 | A | 3/1998 | Brown | |
| 5,842,766 | A | 12/1998 | Scharf, III | |
| 5,879,163 | A | 3/1999 | Brown | |
| 5,899,855 | A | 5/1999 | Brown | |
| 5,913,310 | A | 6/1999 | Brown | |
| 5,918,603 | A | 7/1999 | Brown | |
| 5,933,136 | A | 8/1999 | Brown | |
| 5,940,801 | A | 8/1999 | Brown | |
| 5,943,044 | A | 8/1999 | Martinelli et al. | |
| 5,951,300 | A | 9/1999 | Brown | |
| 5,956,501 | A | 9/1999 | Brown | |
| 6,001,048 | A * | 12/1999 | Taylor | 482/81 |
| 6,032,119 | A | 2/2000 | Brown et al. | |
| 6,091,402 | A | 7/2000 | Howell | |
| 6,144,837 | A | 11/2000 | Quy | |
| 6,167,362 | A | 12/2000 | Brown et al. | |
| 6,213,872 | B1 | 4/2001 | Harada et al. | |
| 6,302,789 | B2 | 10/2001 | Harada et al. | |
| 6,364,315 | B1 | 4/2002 | Velke, III | |
| 6,404,409 | B1 * | 6/2002 | Solomon | 345/31 |
| 6,409,636 | B1 | 6/2002 | Risso et al. | |
| 6,600,477 | B1 | 7/2003 | Howell | |
| 6,641,508 | B1 | 11/2003 | Ignatovich | |
| 6,742,909 | B2 | 6/2004 | Conti et al. | |
| 6,918,769 | B2 | 7/2005 | Rink | |
| 7,021,808 | B2 | 4/2006 | Currie et al. | |
| 7,354,383 | B2 * | 4/2008 | Bardha | 482/82 |
| 2004/0077423 | A1 | 4/2004 | Weston et al. | |
| 2005/0192164 | A1 * | 9/2005 | Epstein | 482/83 |
| 2006/0025282 | A1 | 2/2006 | Redmann | |
| 2006/0121428 | A1 | 6/2006 | Terrazas | |
| 2006/0293041 | A1 | 12/2006 | Kim | |
| 2008/0076637 | A1 | 3/2008 | Gilley et al. | |
| 2008/0076972 | A1 | 3/2008 | Dorogusker et al. | |
| 2008/0077489 | A1 | 3/2008 | Gilley et al. | |
| 2008/0077619 | A1 | 3/2008 | Gilley et al. | |
| 2008/0077620 | A1 | 3/2008 | Gilley et al. | |
| 2008/0077881 | A1 | 3/2008 | Gilley et al. | |
| 2008/0086318 | A1 | 4/2008 | Gilley et al. | |
| 2008/0182724 | A1 | 7/2008 | Guthrie | |

FOREIGN PATENT DOCUMENTS

| | | | |
|---|---|---|---|
| WO | WO03/099389 | A1 | 12/2003 |
| WO | WO2007/134376 | A1 | 11/2007 |

OTHER PUBLICATIONS

Tranum et al.; U.S. Appl. No. 12/396,182 entitled "A physical activity-promoting game utilizing networked modules," filed Mar. 2, 2009.

Ngo et al.; U.S. Appl. No. 12/396,194 entitled "SCOOT: A physical activity-promoting game system," filed Mar. 2, 2009.

Bakshi et al.; U.S. Appl. No. 12/396,222 entitled "Moovdisk," filed Mar. 2, 2009.

Casey et al.; U.S. Appl. No. 12/396,251 entitled "U.S. Appl. No. 12/396,251," filed Mar. 2, 2009.

Stewart et al.; U.S. Appl. No. 12/396,303 entitled "Physical exercise video game method and apparatus," filed Mar. 2, 2009.

Fujiki et al.; "Neat-o-Games: Ubiquitous activity-based gaming"; proceedings of 2007 ACM Conference on Human Factors in Computing Systems (CHI), San Jose, CA; Apr. 28-May 3, 2007.

Fujiki et al.; "Neat-o-Games: Ubiquitous computing meets exertion interfaces"; proceedings of 2007 ACM Workshop on Exertion Interfaces, San Jose, CA; Apr. 29, 2007.

* cited by examiner

RHYTHM ROPE

CROSS-REFERENCE TO RELATED APPLICATION

This application claims priority to U.S. Provisional Patent Application Ser. No. 61/032,896, filed on Feb. 29, 2008, titled "Rhythm Rope."

BACKGROUND OF THE INVENTION

Childhood obesity is on the rise both within the United States and throughout the world. This condition poses a serious problem not only for the affected children, but for the burden on public health and the healthcare system at large. Obesity is associated with many co-morbidities, including vascular diseases such as hypertension and heart disease, chronic inflammation, glucose intolerance, insulin resistance, as well as full blown type 2 diabetes.

In addition to extensive documentation of the association between childhood obesity and poor health outcomes, a number of studies document the positive effects that physical activity has in reducing the risk of poor health outcomes associated with obesity, including reductions in the development of diabetes and heart disease. Physical activity also helps control weight, promotes psychological well-being, and reduces the risk of premature death. The Centers for Disease Control and Prevention (CDC) recommend that young people engage in at least 1 hour of moderate to vigorous physical activity each day to maintain good health.

While the positive effects of regular physical activity are well documented, motivation to maintain adequate levels of activity over the long term is often lacking. Many young people engage in sedentary behaviors (e.g., watching TV, surfing the Internet) and do not meet the CDC recommendations for physical activity. Research has found that physical activity rates decline with age among young people, with overall levels of physical activity typically beginning to decrease when children are of middle school age.

It is recognized that fun, engaging games or related products that require physical activity can be a way to increase physical activity among young people. To succeed in increasing physical activity, games need to appeal to the target population and to fit easily within the existing social, educational, and cultural environment.

Accordingly, there is a need in the commercial and healthcare product markets for smart games and related products that address and counter the growing tendency toward sedentary behaviors and that are directed toward the specific goal of increasing the overall level of physical activity of those who play the game or use the product. To succeed in this goal, products need to be easy to use, and have a quick appeal that can also be sustained over the long term. It is further desirable that such products are safe and require minimal adult supervision. Most of all, the games must be effective at their fundamental goal, which is to increase levels of physical activity.

Jump ropes are well known exercise devices suitable for children. Modifications to the basic jump-rope have been suggested to enhance enjoyment and to encourage more widespread use. However, none of these devices actively encourage and train user activity.

For example, lighted jump ropes, or jump ropes that illuminate all or a part of their length, have been described. U.S. Pat. No. 7,021,808 teaches an "illuminated rope" comprising a translucent fiber optic core with translucent rope surrounding it. Similarly, U.S. Pat. No. 6,742,909 teaches an illuminated rope having a wire-formed light source including a flexible translucent sheathing and elongate flexible cover. U.S. Pat. No. 5,842,766 describes a fiber optic jump-rope including a transparent flexible jump-rope that is a hollow tube in which multiple fiber optic cables are situated. U.S. Pat. No. 5,389,056 teaches an illuminated jump-rope with a hollow, flexible tubular rope and plurality of light bulbs with spherical translucent covers therein. U.S. Pat. No. 5,087,034 describes a lighted jump-rope with a translucent tube and discrete light-emitting elements inserted through slits in the translucent tube. U.S. Pat. No. 4,776,585 describes an electrically lighted jump rope. U.S. Pat. No. 4,529,193 also teaches an illuminatable jump-rope that has two sets of battery operated illuminators, one on each handle. U.S. Pat. No. 5,071,118 describes a specific way of forming an illuminated rope. Finally, U.S. Pat. No. 6,641,508 teaches a jump-rope having a string of lights that can be turned on and off in a pattern.

A number of references also teach musical jump ropes. For example, U.S. Pat. No. 5,533,947 describes a jump-rope that plays a song when the rope is being swung. U.S. Pat. No. 6,409,636 teaches a jump-rope that plays music and can overlay the music with sound effects or sound segments during use.

None of these modified jump ropes provides an interactive, user-responsive jump-rope that can actively encourage and guide physical activity. Described herein are jump ropes that respond and guide user activity by providing rhythmic sounds (e.g., music) and engaging visual cues to guide the user's activity in response to the rhythm provided.

SUMMARY OF THE INVENTION

Described herein are jump-ropes that include a source of music or other rhythmic sounds and which indicate (e.g., by color change) when the user jumps on-beat or off-beat with the rhythm of the music being played.

For example, an improved jump-rope exercise device may include: a pair of handles, wherein each handle includes a grip region and a rope-attachment region; a flexible jump-rope attached to each handle; a source of rhythmic sound including a memory; a motion sensor for sensing motion of the handles, the user and/or the rope; a visual output; and a controller operably connected to the motion sensor and the source of rhythmic sound, wherein the controller is configured to compare the motion of handles with the rhythm of the sound provided by the source of rhythmic sound and activate a visual output based on this comparison.

Any appropriate visual output may be used. For example, the visual output may be a source of colored light configured to provide different colors based on the output of the controller. In some variations, the visual output comprises a source of red, green and yellow illumination. The visual output is configured to illuminate at least a portion of the flexible jump rope.

The jump-rope device may also include a memory configured to record motion activity; wherein the memory is in communication with the controller.

In some variations, the device includes one or more speakers in at least one of the handles for playing the rhythmic sound provided by the source of rhythmic sound. For example, the source of rhythmic sound may be configured to communicate with a wireless head-set. The source of rhythmic sound may be configured to receive input from a digital music player.

Any appropriate sensor may be used as the motion sensor. Multiple sensors may also be used. The sensor may detect motion of the handles (and may be located in the handles). In some variations the sensor may detect the user motion (e.g., jumping motion). The sensor may detect contact between the rope and the floor. The sensor may be separate from the jump-rope. For example, the sensor may be worn or clipped on the users body (e.g., shoe, waist, etc.). The sensor may be attached to the jump-rope, and may be attached in any appropriate location. For example, a sensor may be attached to the handle (or both handles) or the rope. Sensors may be electronic, mechanical, or the like.

In addition to motion-detecting sensors, one or more sensors may also track user activity by determining other physiological characteristics. For example, a sensor may detect heart rate (e.g., pulse), perspiration, or the like. For example, a galvanic sensor may be used in communication with at least one of the handles.

The device may also be configured to be combined with other jump-rope devices. For example, at least one of the handles may be configured to mate with the handle of another improved jump-rope exercise device to form a longer jump-rope exercise device.

Also described herein are methods of guiding activity. These methods may include providing rhythmic sounds from a portion of a jump-rope device, sensing the motion of the jump-rope device, comparing the motion of the jump-rope device to the rhythm of the sound provided by the jump-rope device, and activating a visual output based on this comparison.

In some variations, these methods also include changing the color of at least a portion of the jump-rope device to indicate whether the jump-rope device is moving harmoniously with the rhythmic sound provided. For example, the step of activating a visual output may include changing the color of the rope: green to indicate that the jump-rope device is moving synchronously with the rhythm of the rhythmic sounds provided; yellow to indicate that the jump-rope device has begun to move asynchronously with the rhythm of the rhythmic sounds; or red to indicate that the jump-rope device is continuing to move asynchronously with the rhythm of the rhythmic sounds.

In some variations, the step of providing rhythmic sounds comprises playing music. Further, the methods may also include a step of loading digital music into the source of rhythmic sounds in the jump-rope device.

During operation, the device may track (e.g., record), store, score, and/or display information on use. For example, the device may track and store the comparison information. Thus, in some variations, the method includes the step of displaying comparison information gathered during use of the jump-rope device.

INCORPORATION BY REFERENCE

All publications and patent applications mentioned in this specification are herein incorporated by reference in their entirety to the same extent as if each individual publication or patent application was specifically and individually indicated to be incorporated by reference.

DETAILED DESCRIPTION OF THE INVENTION

The improved jump rope devices described herein generally include a source of rhythmic sound, a sensor for determining the motion of the jump rope, and a visual output (e.g., feedback) for indicating how well a user is moving or jumping in time to the rhythmic component of the sound. The device may also include a controller for receiving input from the source of rhythmic sound and from the sensor, and for controlling the visual output. Methods of using the devices are also described.

A jump-rope device as described herein may also be referred to as a "rhythm rope."

Figures 2A, 2B:
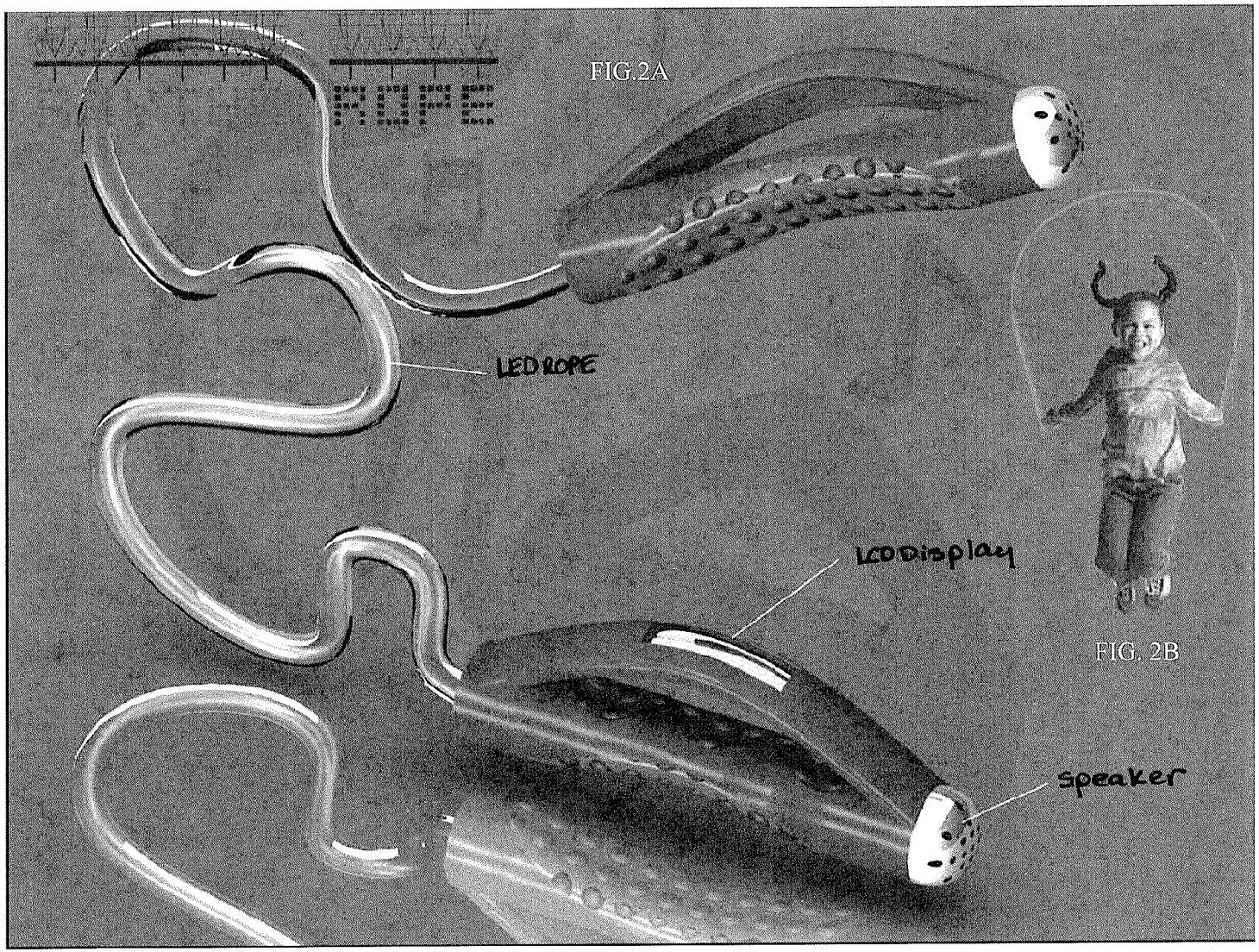
FIG. 2A shows one variation of the improved jump-rope described herein.
FIG. 2B illustrates operation of the jump-rope of FIG. 2A.

The jump-rope devices described herein may be used by a child (or multiple children). For example, music may be uploaded to the device, and/or the device may already include one or more pre-loaded soundtracks. For example, the source of rhythmic sound for the jump-rope device may communicate with a digital music player or other source, such as a computer, stereo, iPod™, or the like. Thus, the source of rhythmic sound may include a memory and may act as an on-board audio file player. The rhythmic sound (e.g., music) may be played by the device during operation. For example, the device may include one or more sound outputs including speakers. Thus, a speaker may be positioned in a handle or both handles (as shown in FIG. 2A). In some variations, the device provides output to one or more headsets. For example, the source of rhythmic sound may output music via Bluetooth or other wireless (or wired) method to an external speaker, headset, or the like.

Virtually any sound file or music may be used with the device, including pre-set music or music that has been uploaded by the user. Typically, this sound source comprises digital audio files. Thus someone using the device may exercise to the beat of their favorite songs. Each audio file may present a new beat and a new challenge. Music playing from the device (e.g., the handles) may help motivates the user and may also guide activity, in combination with the visual cues provided by the device. For example, the beat or rhythm of the music may slow down as well as speed up, and the user may then modify his or her jumping to match the beat, with the device indicating by color change how well the user is doing.

For example, in some variations, the device visually indicates that the user is moving in rhythm with the music supplied. In this example, a region of the device may glow green when the user is jumping in harmony with a song being played. If the user begins to get off pace, the color changes to yellow, and then finally to red. Thus, the device may offer a visual encouragement, motivating the user to move in time to the beat when the device starts to turn yellow, in order to get it back to green.

Any appropriate portion of the device may indicate the color change, including the handle(s) and the rope regions. For example, the rope region may include one or more lights, may be made of an illuminating material (e.g., LED), or may include a light-transmitting material such as a fiber optic.

In addition to the beat or rhythm-matching method of operation, the device may also include one or more games that may be played, and the device may store and display a score during use. A score can be determined by how often the LED rope is glowing green compared to other colors. Additional games may also be played. For example, the device may change color based on the rate at which the rope is moving (the rate of jumping), either in time to music or independently of the sounds provided. In addition, a "follow-the-leader" type game may also be played. For example, the device may provide musical or spoken instructions (e.g., "jump fast", "jump slow", "stop", "jump faster", "jump on one foot", etc.), and may score compliance with the instructions based on inputs from the motion sensor; visual output may also indicate play status (e.g., color change). Game play may be single-player or multi-player, and scores can be stored and compared. For example, "high scores" may be stored and displayed.

In addition to the color indicators, the devices may also have additional outputs, including downloadable information (e.g., to a computer, server, etc.), a display screen (e.g., LED screen), or the like. The screen may also be used to present a menu of options (e.g., games, etc.). Thus the device (e.g., the handle region) may include one or more user inputs, such as buttons, knobs, dials, etc.

The device also has the added advantage that it is intuitive and easy to understand. Furthermore, the device may be collapsible and very portable, making it easy to carry and use virtually anywhere.

In addition, the devices can be used by one person, or shared with multiple people. For example, the devices may be linkable, so that two devices can be joined to form a single (longer) device. One or both handles of the devices may be configured to engage with another handle (or handles) of another device. In some variations, one or both handles are removable, and the end of the rope may be configured to engage with a similar device. The engagement between the two devices may allow communication between them (e.g., controller-to-controller), and may result in one controller being subservient to the other, so that the device can function as a single, longer, device.

The device may also be configured to communicate with each other, and thereby allowing enhanced play. For example, when more than one device is played in proximity to another device, the device may detect each other, thus enabling multiplayer game play (e.g., coordinated colors, interactive game play, etc.). Sensors may be wireless, and detection/interaction may be automatic or manual. In some variations, a separate module may be added to the device to enable interactive play.

Figure 1:
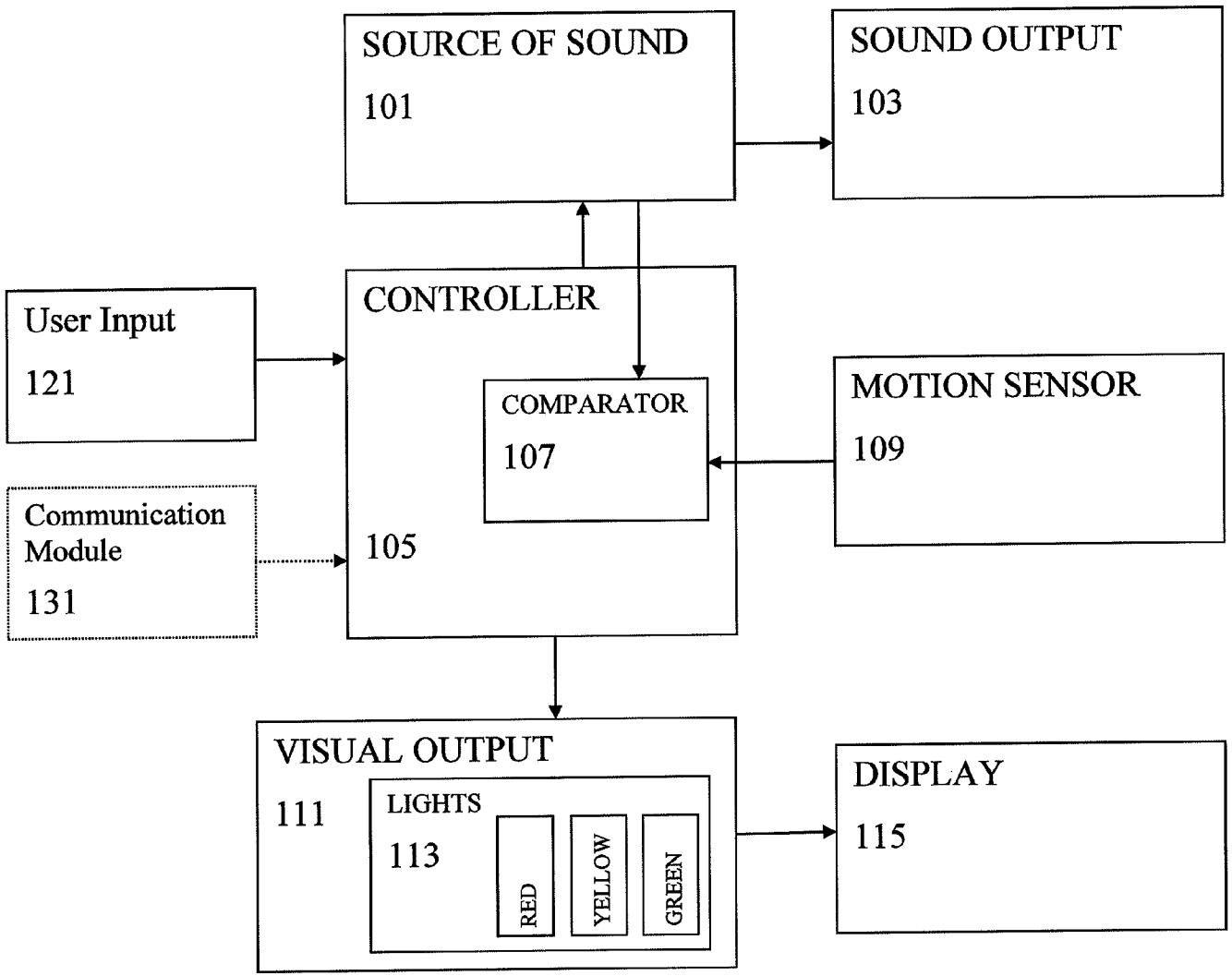
FIG. 1 is a schematic diagram illustrating some of the components of the improved jump-rope described herein.

FIG. 1 is a schematic diagram illustrating some of the elements that may form an improved jump-rope device. For example, in FIG. 1, a source of sound 101 is shown connected to the controller 105, and provides output to one or more outputs 103, such as a speaker, headset, or the like, so that the user can hear the sounds played. As described above, the sounds may be any appropriate sounds, including music, spoken words, or other sounds. Sounds having a strong rhythmic content are particularly preferred, but any sounds may be used.

The controller 105 also typically receives input from a motion sensor 109, and may also receive user input 121. User input may be provided by direct connection (e.g., buttons, etc.) or by wireless connection. For example, the user may select options such as game play, starting a game, game selection, etc. from a drop-down menu shown on a screen or display 115, or based on preset controls. The controller can also provide output, including visual output 111, and allow selection of one or more sound files 101 and instruct the source of sound 101 as to which sound file to play, what speed to play, etc. The controller 105 can also provide output(s) to a display 115, including those outputs previously mentioned.

In addition to user input, the jump-rope may include (optionally) a communication module including one or more input or sensors 131 to detect and communicate with other jump-rope devices, as mentioned above. For example, the devices may include a communication module for communication with other jump-rope devices. This module may include a wireless communication device (e.g., Bluetooth, or other wireless system), and/or additional game logic to enable play of multiplayer games.

The controller 105 may also include a processor and a memory. For example, the controller 105 may include a comparator 107 that can be used to compare the rhythmic content of the sound being provided by the source of sound 101 with the output of the motion sensor. Thus, the controller may also include appropriate hardware, software or firmware for detecting and analyzing the input from the motion sensor and source of sound (e.g., D/A converters, analysis logic, etc).

The visual output 111 may also be controlled by the controller 105. For example, the controller may determine if a user is on-beat or off-beat and for how long. Based on this analysis, the controller 105 may instruct the visual output to display an appropriate color output. For example, the visual output may be illumination of the rope to a green color (if the user is on-beat), a yellow color (if the user has begun to go off-beat or is transitioning to on-beat) and a red color (if the user is off-beat for a predetermined amount of time). Other visual outputs, including a display 115, may also be instructed by the controller 105 to provide feedback to the user.

FIGS. 2A and 2B illustrate one variation of an improved jump-rope device. For example, FIG. 1 shows a perspective view of one variation of a device ("Rhythm Rope") including two handles. In this example, each handle includes a speaker, a grip region, and an LCD display. The handles are connected by a flexible rope that includes one or more LEDs that can illuminate the device.

Any suitable rope, fiber, chain, or the like may be used as the jump-rope extending between the two handles. For example, the rope may be a single tube, or may be formed of a woven material or a chain of interconnected links. In particular, ropes that can be illuminated in different colors are particularly useful. In FIG. 2A the rope is a tube including one or more LED (light-emitting diodes) that can be controlled to change the color of the rope.

FIG. 2B illustrates use of the jump-rope in FIG. 2A. This example shows a child using the rope, which is illuminated green to indicate that the rhythm that the child is jumping is synchronous with the rhythm of the music being played.

While the improved jump-rope devices and methods for using them have been described in some detail here by way of illustration and example, such illustration and example is for purposes of clarity of understanding only. It will be readily apparent to those of ordinary skill in the art in light of the teachings herein that certain changes and modifications may be made thereto without departing from the spirit and scope of the invention.

What is claimed is:

1. A jump-rope exercise device comprising:

a pair of handles, wherein each handle includes a grip region and a rope-attachment region;

a flexible jump-rope attached to each handle;

a source of rhythmic sound including a memory;

a motion sensor for sensing motion of the handles;

a visual output; and a controller operably connected to the motion sensor and the source of rhythmic sound, wherein the controller is configured to compare the motion of handles with the rhythm of the sound provided by the source of rhythmic sound and activate a visual output based on this comparison.

2. The device of claim 1, wherein the visual output comprises a source of colored light configured to provide different colors based on the output of the controller.

3. The device of claim 1, wherein the visual output comprises a source of red, green and yellow illumination.

4. The device of claim 1, wherein the visual output is configured to illuminate at least a portion of the flexible jump rope.

5. The device of claim 1, further comprising a memory configured to record motion activity; wherein the memory is in communication with the controller.

6. The device of claim 1, further comprising a speaker in at least one of the handles for playing the rhythmic sound provided by the source of rhythmic sound.

7. The device of claim 1, wherein the source of rhythmic sound is configured to receive input from a digital music player.

8. The device of claim 1, wherein the source of rhythmic sound is configured to communicate with a head-set.

9. The device of claim 1, further comprising a galvanic sensor in communication with at least one of the handles.

10. The device of claim 1, wherein at least one of the handles is configured to mate with the handle of another improved jump-rope exercise device to form a longer jump-rope exercise device.

11. The device of claim 1, further comprising a communication module configured to communicate with other jump-rope devices to affect gameplay.

12. A method of guiding jump-rope activity comprising:

providing rhythmic sounds from a portion of a jump-rope device;

sensing the motion of the jump-rope device;

comparing the motion of the jump-rope device to the rhythm of the sound provided by the jump-rope device; and activating a visual output based on this comparison.

13. The method of claim 12, further comprising changing the color of at least a portion of the jump-rope device to indicate whether the jump-rope device is moving synchronously with the rhythmic sound.

14. The method of claim 12, further comprising wherein the step of activating a visual output comprises changing the color of the rope: green to indicate that the jump-rope device is moving synchronously with the rhythm of the rhythmic sounds provided; yellow to indicate that the jump-rope device has begun to move asynchronously with the rhythm of the rhythmic sounds; or red to indicate that the jump-rope device is continuing to move asynchronously with the rhythm of the rhythmic sounds.

15. The method of claim 12, wherein the step of providing rhythmic sounds comprises playing music.

16. The method of claim 12, further comprising loading digital music to a source of rhythmic sounds in the jump-rope device.

17. The method of claim 12, further comprising tracking and storing the comparison information.

18. The method of claim 12, further comprising displaying comparison information gathered during use of the jump-rope device.

* * * * *